United States Patent [19]

Luke et al.

[11] 4,149,546

[45] Apr. 17, 1979

[54] PRODUCTION OF TOBACCO-SMOKE FILTERS

[75] Inventors: John A. Luke, Romsey; Raymond J. Harrison, Southampton, both of England

[73] Assignee: British-American Tobacco Company Limited, London, England

[21] Appl. No.: 776,522

[22] Filed: Mar. 11, 1977

[30] Foreign Application Priority Data

Mar. 17, 1976 [GB] United Kingdom ..... 10774/76

[51] Int. Cl.[2] ..... A24C 5/50

[52] U.S. Cl. ..... 131/94; 425/383; 425/392

[58] Field of Search ..... 131/88-94, 131/209; 93/1 C; 425/383, 385, 392, 394, 396, 397, 402, 369; 249/59; 156/581, 583, 196-198, 209; 264/119, 128, 320, 322, 323, 319; 72/103-106, 703

[56] References Cited

U.S. PATENT DOCUMENTS

| | | | |
|---|---|---|---|
| 3,304,943 | 2/1967 | Gunther | 131/209 |
| 3,464,421 | 9/1969 | Pinkham et al. | 131/88 R |
| 3,702,118 | 11/1972 | Terasaki | 131/209 |
| 4,025,263 | 5/1977 | Morino | 425/385 |

*Primary Examiner*—Robert W. Michell
*Assistant Examiner*—V. Millin
*Attorney, Agent, or Firm*—Kane, Dalsimer, Kane, Sullivan & Kurucz

[57] ABSTRACT

For shaping a component of a smoke filter, a rod of the material to be shaped and a heated former are relatively moved in contact with each other, in an arcuate path, in a direction transverse to the longitudinal axis of the rod, whereby an impression, for example an annular or helical groove, is produced in the rod by the former. For the said relative movement, the rod may be supported at the periphery of a rotor, while the former comprises a heated arcuate stator element or elements projecting inwardly towards the rotor. The rod may be turned about its axis during the relative movement, for example by a pair of rollers by which it is supported at the periphery of the rotor. A surface or surfaces bounding the impression, for example the bottom surface of a groove, may be sealed, during the shaping operation, so as to be smoke-impervious.

17 Claims, 5 Drawing Figures

Fig. 3
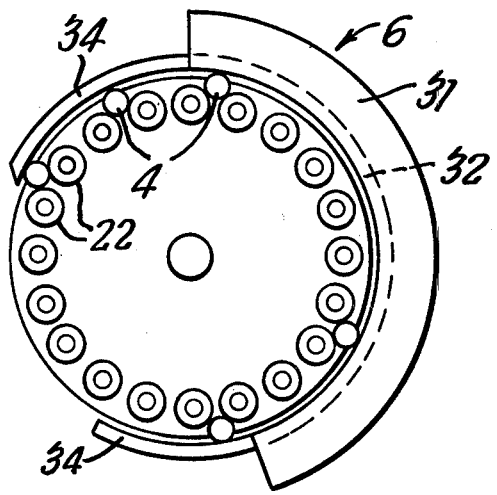
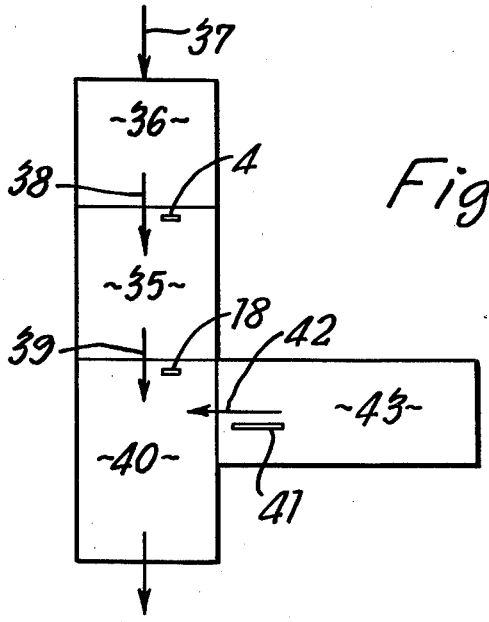
Fig. 5

PRODUCTION OF TOBACCO-SMOKE FILTERS

This invention concerns improvements relating to the production of smoke-filter components and filters for smoking articles, particularly but not exclusively tobacco-smoke filter components for cigarettes. It seeks especially to provide improved methods and apparatus by which regions of rod-shaped material for the production of such components can be substantially modified to improve or adapt the rod for the purpose of achieving desired smoke-filtration effects or characteristics and/or for the purpose of facilitating manufacture.

Prior proposals relating to the manufacture of filters from rod material have generally involved working on a continuous rod or on a rod of multiple filter-plug length whilst it is moving in the direction of its longitudinal axis, usually at high speed. This gives rise to difficulties in manufacture due, for example, to the limited time available for working on a rod moving at high speed, to the necessity for precise timing and to the intermittent nature of the operations to be performed on the rod.

According to the present invention, in a method or apparatus for shaping a rod component of a smoke filter, a rod of the material to be shaped and a heated forming means are relatively moved in contact with each other, in an arcuate path, in a direction transverse to the longitudinal axis of the rod, whereby an impression is produced in the rod by the forming means. Preferably, the rod is supported and conveyed for the relative movement at the periphery of a drum-shaped inner rotor and the forming means comprises a heated arcuate outer stator element or elements projecting inwardly towards the rotor. Such an element may consist simply of a heated bar having a rod-contacting profile complementary to the impression to be produced by it in the rod under the effects of heat and pressure thereby applied.

Generally, in practice, the rod to be shaped will have a length which is a multiple of the length of an individual finished component, for example of a filter plug.

The rod may or may not be also turned about its axis during the relative movement in the direction transverse to that axis. For this purpose, the rod may be supported at the periphery of the rotor by means of a pair of rollers extending parallel to the longitudinal axis of the rod, the said rollers being rotated about their axes for imparting to the rod turning movement about its axis.

Various impressed formations may be produced by the aforesaid method, for example and in a simple case one or more annular grooves extending continuously around the rod. Generally the impression will extend along a part only of the length of the rod. For producing a groove extending helically around the rod, the heated stator element may be positioned at an angle other than a right angle in relation to the transversely positioned rod.

Because the rod is operated upon whilst it is moving in a direction transverse to its longitudinal axis, more time is available for working on the rod. Not only can a better shaping operation be achieved in simple fashion and by simple means, but it is also possible to manufacture economically a wide variety of filters without the use of complicated and expensive machinery for pinching or other operations which would require intermittency of movement in the case of movement in the longitudinal direction.

The filter rods may be made of various filtering materials, such as thermoplastic polymers, for example cellulose acetate or polypropylene. Paper filters would be suitable if the paper was wetted or contained a proportion of thermoplastic material or was coated with heat-activated adhesive. The rod material may contain additives such as carbon. It may consist of concentric tubes, for instance an inner one of paper and an outer one of plastics material. Parts at least of composite or multiple filter rods may be so produced even if not all of the sections are necessarily capable of permanent deformation.

Before being shaped, the filter material or rod may be sprayed or otherwise treated with a fluid additive, including water or steam, in order to condition the rod and minimise risk of damage to the materials.

Preferably, the shaped rod is wrapped in wrapping material while moving in a direction transverse to the longitudinal axis of the rod. A simple wrapping operation can be thus achieved. Advantageously, the aforesaid shaping and wrapping operations are performed on a single machine or assembly, preferably in combination with a filter-tip attaching unit or machine.

One manner of carrying out the invention will now be more fully described, by way of example, with reference to the accompanying diagrammatic drawings in which:

FIG. 3 is an end view, again to the larger scale, illustrating the manner in which rods to be formed are supported in the forming unit.

FIG. 5 is a box diagram illustrating modes of use of the machine.

Figure 1:
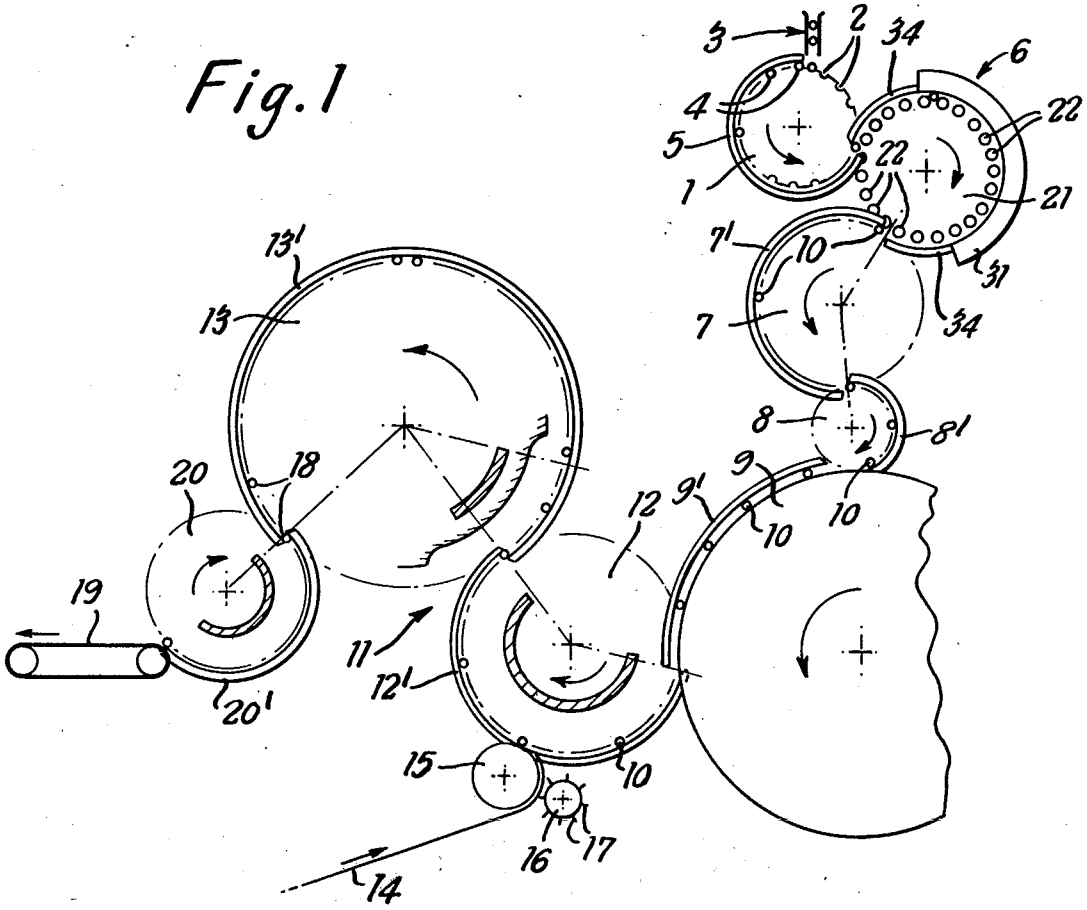
FIG. 1 is a general end view of a complete filter-rod making machine, including forming and wrapping units.

The machine shown in FIG. 1 comprises a receiver drum 1 having in its circumferential surface longitudinal grooves 2 for receiving through a chute 3, from a source (not shown), plain cylindrical rods 4 of tobacco-smoke filtering material, for example cellulose acetate, and supplying the rods, retained in the grooves in positions parallel to the drum axis by an arcuate guide 5, to a rod-forming unit 6 hereinafter described. Transfer means, in the form of three transfer drums 7, 8 and 9 with arcuate guides 7', 8' and 9' serve to transfer filter rods 10, shaped in the unit 6, to a wrapping unit 11, the rods retaining their transverse dispositions throughout such transfer. The drums 7 and 8 are formed with longitudinal rod-receiving grooves similarly to the drum 1.

The unit 11 comprises a collating drum 12 and a wrapping drum 13 which again have longitudinal rod-receiving grooves and guides 12' and 13'. The drums 12 and 13 operate in per se known manner. The drum 12 is fed with wrapping material, for example paper, supplied in the form of a continuous web 14 from a reel (not shown) with the assistance of a roller 15. The latter co-operates with a cutting roller 16 which carries a number of radially extending knives 17 at intervals appropriate for severing the web, whose width is equal to the length of the rods 10, into separate lengths for wrapping around the individual rods, which lengths are then fed by the roller 15 to the drum 12, one length being thereby collated with each rod 10 in known manner.

The web 14 on its path from the reel to the roller 15 is fed past an applicator (not shown) which applies adhesive to that surface of the web which will be in contact with the rods. Each length, carrying a coat of adhesive, is brought into contact with a rod 10 carried at the periphery of the drum 12. The rods 10 pass, together with their respective lengths of wrapping material, from the drum 12 to the drum 13, where, in a position transverse to its axis, each rod is rotated about its axis without being moved longitudinally and becomes wrapped in its respective said length, the longitudinal edges being brought into contact so as to become adhered together by the adhesive. From the drum 13, the wrapped rods 18 are transferred to a catcher band 19 by a longitudinally grooved transfer drum 20 having a guide 20'.

For operation of the machine, the drums 1, 7-9, 12, 13 and 20, rollers 15, 16 and band 19 are driven from a power source (not shown) in co-ordination with each other and with the forming unit 6 now to be described.

The forming unit 6 consists of rotor and stator sections. The rotor section comprises two circular end discs 21 (FIG. 2) in which are journalled a circular series of small rollers 22, which preferably have knurled surfaces. Pairs of adjacent rollers 22 serve to receive rods from the drum 1 and to support them, between peripheral regions of the said rollers, while the rods are carried through the unit by the turning of the rotor. The rotor is driven by a shaft 23, suitably by an electric motor (not shown). A coupling, indicated diagrammatically at 24, may be provided between the end discs 21 to facilitate axial adjustment of the unit to accommodate different lengths of rod to be shaped. Rotation of the rollers 22 about their axes is imparted through planet wheels 25 which are fast on the extended journals at one end and mesh with a sun wheel 26. The sun wheel 26 is rotationally fast on a shaft 27 driven by another motor (not shown). If, as shown, the adjacent disc 21 is supported by way of a stub 28 in a bearing 29 in the wheel 26 and/or shaft 27, provision may again be made, as indicated diagrammatically at 30, for some relative axial adjustment. The motors may be controllable-speed motors, so that the revolution speed of the rotor and the revolution speed of the rollers about their axes can be selected to suit requirements, more particularly so that the number of revolution of the rods during their passage past the stator can be varied or controlled. If this facility is not required, drives for the rotation of the rotor and for the rotation of the rollers about their axes may be derived from a common source.

Figure 2:
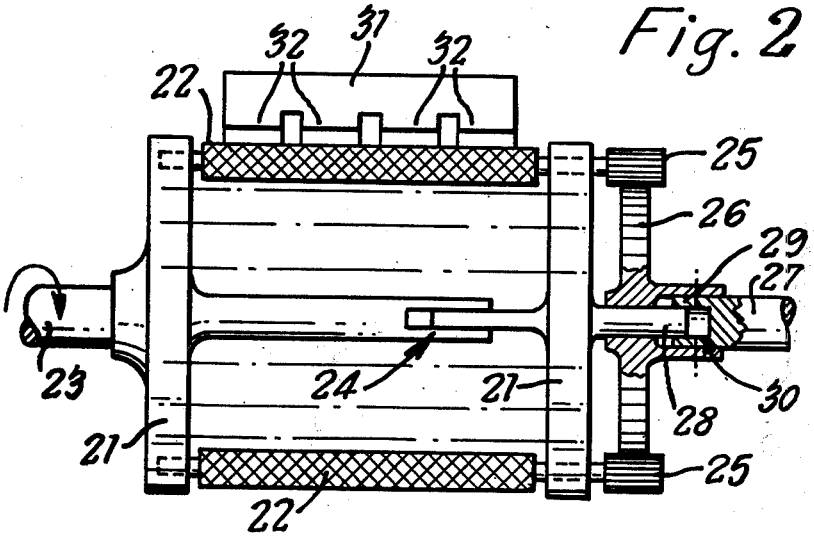
FIG. 2 is an elevational view, at right angles to FIG. 1 and to a larger scale, of the forming unit.

The stator section comprises an outer arcuate member 31 having radially inwardly projecting portions 32 in the form of arcuate ribs. The member 31 is provided, at least in the projecting portions, with heating means, preferably in the form of electrical elements embedded therein per se known manner. The number, shape and disposition of the projecting portions will be complementary to required depressions 33 to be formed in the rod 10. The shape of rod shown in FIG. 4, to which the cross-sectional stator shape shown in FIG. 2 is complementary is given purely by way of example. Arcuate guides 34 (FIG. 1) extend from the ends of the member 31 to points adjacent to the drums 1 and 7 respectively.

The member 31 and its projecting portions 32 will generally extend at a constant radial distance from the axis of the rotor. However, the proximity of the said portions 32 to the rotor may increase in the direction of rotation so that the shaping effect is progressive.

In operation of the unit 6, rods deposited one by one from the drum 1 between pairs of rollers 22 are carried by the rotation of the rotor past the stator member 31 while being rotated about their axes by the rotation of the rollers 22. The rotating rods 10 are thereby pressed against the projecting stator portions, e.g. 32, so that annular depressions or spaced-apart zones of reduced diameter e.g. 33, are formed in the rods under the effects of heat and pressure.

It is preferred to employ means for rotating the rods about their axes by positively driving the rollers 22. For some purposes, however, the rods may be rotated as a result only of their contact with the stator member 31.

Provision may be made for controlling the stator heating means. The required temperature of the projecting portions 32 will depend upon the characteristics of the material of the rods and their residence time in the stator. It should be between the softening and scorching temperatures of that material. It would be below the scorching temperature of paper, if the rod were already paper-wrapped when shaped. It is an advantage of the arrangement described that the residence time can be made long, whereby lower temperatures can be employed and risk of damage to the filter material and any wrapping can be reduced.

If it is required that parts of the surface of the rod, whether external cylindrical surfaces or bottom and/or side surfaces of grooves or other depressions, should be partially or completely sealed against the penetration of smoke constituents into the rod, this may be achieved by making the stator temperature in a required region or regions sufficiently high to produce local superficial fusion and resultant partial or complete sealing of the rod material.

In practice, rods 10 of the length of a single filter will not normally be shaped in the unit 6, but rather rods of a length which is a multiple, for instance six, of the single length, such rods being subsequently cut into the single lengths.

Figure 4:
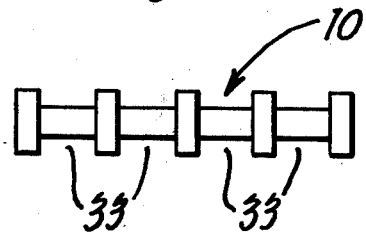
FIG. 4 illustrates a filter rod formation producable by the unit of FIG. 2.

A forming unit such as has been described can be utilised for producing various kinds of shapes of filter elements or parts thereof. Annular-grooves may be of rectangular section, as shown in FIG. 4 or of rounded, V or other section, and may be provided in any required sizes, dispositions and numbers and with constant or varying depth and/or width. In effect a generally cylindrical rod body with outwardly projecting annular ribs may be obtained. Non-annular formations, for example a helical groove or grooves, may be produced by the use on the stator of projecting portions which are in a plane at an angle other than a right angle to the transverse direction in which the rods extend as they are carried, rotating slowly about their axes, but without axial movement, through the unit 6, the pitch of the helix being dependent upon the said angle. Filter end formations may be produced, for example conical, crowned or oblique ends or folded, corrugated or finned ends, possibly in conjunction with at least partial sealing of such ends. Shaping may be applied primarily or partially with the object of achieving differential compaction or packing factor (the proportion of filter volume occupied in the case of a fibrous filter material). For instance a cylindrical rod portion may be adjoined by a compacted tapering portion.

Formations may be produced which do not extend around the whole circumference and which may be staggered circumferentially in relation to each other. Depressions bounded at the bottom by a chordal boundary may be obtained. Such formations can be produced by selection of lengths, shapes and positions of the projecting stator formations and of the speed of rotation of the rotor. For some purposes, the rods will not be allowed to turn about their axes as the rotor rotates, whereby a depression will be produced on one side only of the rod. A similar depression can be produced on the opposite side by turning the rod over or feeding it to a second forming unit 6.

Formations such as have been referred to can be produced in conjunction with an internal cavity and with either a closed or open end or ends by using initially hollow or tubular rod material.

Longitudinal formations can be produced, either alone or in conjunction with circumferential formations, by using projecting stator portions which extend transversely of the stator. A pattern of longitudinal depressions, cavities or perforations, ribs or teeth, including staggered grooves, can be thus produced, if required in combination with circumferential depressions.

For many purposes, required formations can be produced using a single forming unit 6 as the rod shaping means. However, more than one forming unit may be employed to perform different shaping operations or to complete one operation in more than one stage. Parts of a filter element may be shaped by separate forming units and brought together subsequently.

For example, for filters with ribbed bodies enclosed within a hollow cylinder, the latter may be closed by a conically terminated plug portion produced in the above described manner. Composite filters may, for instance, comprise plain acetate plugs at the ends with a carbon-filled acetate portion in the middle, the latter being compressed, so as to form an annular path through which the smoke can flow past the carbon instead of through it. A high-performance filter with a cellulose-acetate filtration character may comprise two solid cylindrical bodies with conical adjacent ends assembled with a plain hollow cylindrical filter body of smaller diameter between them.

The invention makes possible the production, at high speed, of a number of filters which could only be made otherwise, if at all, with great difficulty and by expensive means and at comparatively low speeds. It also increases the versatility of a filter rod-making machine, as one type of rod-shaping device can readily be replaced by another in the same basic machine.

A rod-shaping and wrapping machine such as has been described with reference to FIGS. 1 to 4 may be used in various ways and in close combination with other apparatus. As illustrated, it is supplied with precut rods 4 from a stock and the shaped and wrapped rods 18 are delivered to stock by the band 19. As illustrated diagrammatically in FIG. 5, however, the rod forming and wrapping machine or unit 35 may be combined or assembled with a known rod producing machine or unit 36, for example a machine to which a filter material, for example a tow of cellulose acetate, is supplied at 37 and from which rods 4 produced and cut therein are supplied at 38 to the machine 35. For this purpose, the usual fluted drum employed in the known rod-producing machine for catching and arresting longitudinally moving rods and moving them off in a direction transverse to their axes may be simply replaced by means for feeding the rods to the rotor of the unit 6 in FIG. 1. Alternatively the unit 6 may be disposed adjacent to the catcher drum and the rods fed from the latter to the said unit. With either of the above arrangements, instead of feeding the rods 18 from the machine 35 to stock, they may be supplied at 39 directly to a filter-tip attaching machine or unit 40 to which wrapped rods 41 of cigarette tobacco are supplied at 42 either from stock or, advantageously, directly from a known cigarette-making machine 43. The machine or unit 40 is so devised, as in the case of the rod forming and wrapping machine described with reference to FIGS. 1 to 4, that the rods 18 pass through it in the transverse position. As diagrammatically indicated, the tobacco rods 41 are fed in an axial position from the machine 43 to the unit 40 which is located, with the unit 35, laterally in relation to the machine 43. The rods 41 are thus presented in a position appropriate for co-axial assembly with the shaped filter rods 18. In the unit 40, the tobacco rods 41 and the filter rods 18 may be assembled by per se known means.

The units 35 and 40 may form an assembly which can be applied in simple fashion to the machine 43 and driven in co-ordination therewith.

For producing dual-section or multiple-section filters, the shaped rods 10 may be cut into individual section lengths before being wrapped, means being provided for interposing other cut filter sections supplied from a different source. For each filter, one each of the said section lengths and other sections are assembled in a single wrapping.

We claim:

1. A method of shaping a rod component of a smoke filter, wherein a rod of the material to be shaped and a heated forming means having a rod contacting portion of a predetermined configuration for shaping the rod are relatively moved in contact with each other, in an arcuate path, in a direction transverse to the longitudinal axis of the rod, whereby an impression is produced in the rod by the forming means.

2. A method according to claim 1, wherein the rod is supported and conveyed for the relative movement at the periphery of a drum-shaped inner rotor and the forming means comprises at least one heated arcuate outer stator element projecting inwardly towards the rotor.

3. A method according to claim 2, wherein the rod is supported at the periphery of the rotor by means of a pair of rollers extending parallel to the longitudinal axis of the rod.

4. A method according to claim 3, wherein the supporting rollers are rotated about their axes for imparting to the rod turning movement about its axis.

5. A method according to claim 1, wherein the rod is also turned about its axis during the relative movement in the direction transverse to that axis.

6. A method according to claim 1, wherein the shaped rod is wrapped in wrapping material while moving in a direction transverse to the longitudinal axis of the rod.

7. A method according to claim 6, wherein the rod is transferred between the shaping and wrapping operations by movement in a direction transverse to its said axis.

8. A method according to claim 1, wherein at least one surface bounding the impression is sealed, during the shaping operation, so as to be impervious to the smoke.

9. A method according to claim 1, wherein the impression is a groove around the rod and at least one surface bounding the groove is sealed during the shaping operation.

10. A method according to claim 1, wherein the impression is a helical groove.

11. Apparatus for shaping a filter-rod component, comprising heated forming means having a rod contacting portion of a predetermined configuration for shaping the rod and means for relatively moving a rod of the material to be shaped and the said forming means in contact with each other in an arcuate path in a direction transverse to the longitudinal axis of the rod.

12. Apparatus according to claim 11, wherein the rod is supported and conveyed, for the relative movement, at the periphery of a drum-shaped inner rotor and the forming means comprises at least one heated arcuate outer stator element projecting inwardly towards the rotor.

13. Apparatus according to claim 12, wherein, for supporting the rod at the periphery of the rotor, a pair of rollers is provided extending parallel to the longitudinal axis.

14. Apparatus according to claim 13, wherein means is provided for rotating the said rollers about their axes and thereby imparting to the rod turning movement about its longitudinal axis.

15. Apparatus according to claim 11, wherein there is provision for also turning the rod about its axis during the relative movement in the direction transverse to that axis.

16. Apparatus according to claim 11, comprising in operative combination with the rod-shaping means, rod-wrapping means in which the rod is wrapped while being moved in a direction transverse to its longitudinal axis.

17. Apparatus according to claim 16, wherein the rod-shaping means, rod-wrapping means and a filter-tip attaching means to which the wrapped rod is supplied are applied as an assembly laterally to a cigarette-making machine arranged to supply tobacco rods to the attaching means.

* * * * *